US010233051B2

(12) United States Patent
Ferraro

(10) Patent No.: US 10,233,051 B2
(45) Date of Patent: Mar. 19, 2019

(54) ASSEMBLING REELS WITH SPRING-LOADED MAGNETIC GUIDES

(71) Applicant: Carris Reels, Inc., Proctor, VT (US)

(72) Inventor: David Ferraro, Proctor, VT (US)

(73) Assignee: Carris Reels, Inc., Proctor, VT (US)

( * ) Notice: Subject to any disclaimer, the term of this patent is extended or adjusted under 35 U.S.C. 154(b) by 44 days.

(21) Appl. No.: 15/410,059

(22) Filed: Jan. 19, 2017

(65) Prior Publication Data

US 2018/0201468 A1 Jul. 19, 2018

(51) Int. Cl.

| | |
|---|---|
| ***B65H 75/14*** | (2006.01) |
| ***B25B 11/02*** | (2006.01) |
| ***B65H 75/50*** | (2006.01) |
| *B25B 11/00* | (2006.01) |

(52) U.S. Cl.

CPC ..... *B65H 75/14* (2013.01); *B25B 11/02* (2013.01); *B65H 75/50* (2013.01); *B25B 11/002* (2013.01)

(58) Field of Classification Search

CPC ..... B65H 75/14; B65H 75/50; B25B 11/02; B25B 11/002; B25B 23/0085; B25B 23/12; H05K 13/028; Y10T 29/53196

USPC ..... 81/13, 44

See application file for complete search history.

(56) References Cited

U.S. PATENT DOCUMENTS 3,386,156 A * 6/1968 Griesemer ..... H05K 13/028 269/8
D582,755 S * 12/2008 Rogers ..... D8/358
7,866,233 B2 * 1/2011 Swanson ..... B25B 23/0085 81/13
8,640,981 B2 * 2/2014 McDonough ..... B29C 45/4407 242/614
9,499,371 B2 * 11/2016 McDonough ..... B29C 45/4407
9,637,346 B2 * 5/2017 Connell ..... B65H 75/22
2005/0155211 A1 * 7/2005 Powell ..... B25B 23/0085 29/467
2011/0204176 A1 * 8/2011 McDonough ..... B29C 45/4407 242/614.1
2014/0117145 A1 * 5/2014 McDonough ..... B29C 45/4407 242/614

(Continued)

FOREIGN PATENT DOCUMENTS

CH 699534 B1 * 3/2010 ..... B25B 9/00
DE 102005042263 A1 * 3/2007 ..... B25B 9/00

*Primary Examiner* — Jacob J Cigna

(74) *Attorney, Agent, or Firm* — The H.T. Than Law Group

(57) ABSTRACT

A method for assembling a reel comprising a first flange, a second flange and a barrel is disclosed. This method comprises (i) securing at least one spring-loaded magnetic guide to a base; (ii) positioning the first flange over the at least one spring-loaded magnetic guide and the base, so that a distal end of the at least one spring-loaded magnetic guide is inserted through a first hole in the first flange, (iii) connecting the barrel to the first flange, (iv) connecting the second flange to the barrel so that the barrel is located between the first and second flanges, (v) inserting at least one threaded fastener through a second hole in the second flange such that a distal end of the at least one threaded fastener is magnetically attached to the distal end of the at least one spring-loaded magnetic guide, and (vi) connecting the at least one threaded fastener to the first flange to form the reel. Also disclosed are the structures of the spring loaded magnetic guide.

16 Claims, 8 Drawing Sheets

(56) References Cited

U.S. PATENT DOCUMENTS

2018/0201468 A1* 7/2018 Ferraro ..... B65H 75/14

* cited by examiner

ASSEMBLING REELS WITH SPRING-LOADED MAGNETIC GUIDES

FIELD OF THE INVENTION

The present invention relates to a method of assembling flanges to a barrel to form reels guided by spring-loaded magnetic guides or jigs, and to the spring-loaded magnetic guides for assembling reels.

BACKGROUND OF THE INVENTION

Up to now, assembling a reel with two similar flanges and a barrel therebetween with bolts or screws that traverse the length of the barrel to fasten the two flanges together requires manual alignments to line-up the bolt-receiving holes on one flange to the corresponding bolt-receiving holes on the opposite flange. Such reels are commonly used to hold wounded wires or cable on the barrel and supported by the flanges. Due to the small diameter of these holes relative to the diameter of the flanges, misalignment by half of the diameter or less of the bolts or screws could cause the bolts or screws not to connect corresponding bolt-receiving holes.

SUMMARY OF THE INVENTION

Hence, the present invention is directed to a method of assembling reels from a pair of matching flanges using a plurality of bolts or screws. The inventive method includes the step(s) of using spring-loaded magnetic guides held in an assembling base. A first flange is positioned on the assembling base, such that the spring-loaded magnetic guides also protrude through the first flange. A barrel or tube is attached to the first flange, preferably by inserting the barrel into a route groove defined on the inside or wire-side surface of the flange. A second flange is similarly attached to the opposite end of the barrel. The bolts or screws are inserted through the second flange. The distal tips of the bolts and screws, which are made from a ferrous metal, would be attracted magnetically to the spring-loaded magnetic guides, thereby self-aligning the bolts or screws to the guides.

As the bolts or screws are advanced by rotations toward the first flange, the bolts or screws press against the spring within the spring-loaded magnetic guides compressing the guides, such that the threads on the distal ends of the bolts or screws are threadedly attached to the first flange to complete the assembling of the reel.

In one embodiment, some of the bolts or screws are inserted from the second flange to the first flange and the remaining bolts or screws are inserted from the first flange to the second flange.

In another embodiment, self-tapping lagging bolts are used so that the distal ends of the bolts tap into the bolt-receiving holes and create a threaded channel in these holes. The lagging bolts pull the first and second flanges toward each other.

In another embodiment, screws are used. Corresponding threaded nuts are inserted into the bolt receiving holes in the first flange and the tips of the spring-loaded magnetic guides protrude through the nuts. As the screws advance by rotation, they displace the guides and thread into the nuts to complete the connection. Alternatively, the nuts are made from ferrous material and can be magnetized by the spring-loaded magnetic guides and attract the distal ends of the screws. Due to the magnetization of the nuts, it is not necessary for the magnetic guides to be spring-loaded. In another embodiment, the nuts can be magnetized by other means and the magnetic guides can be omitted. For example, the nuts can be made from a permanent magnet or include permanent magnetic material therewithin.

In yet another embodiment, a magnetic disk is attached near the distal end of the spring-loaded magnetic guides to increase the magnetic force attracting the distal end of the bolts or screws.

The invention is also directed to spring-loaded magnetic guides or jigs, described and claimed herein.

These and other objects of the present invention are realized by a method for assembling a reel comprising a first flange, a second flange and a barrel comprising the steps of (i) securing at least one spring-loaded magnetic guide to a base;

(ii) positioning the first flange over the at least one spring-loaded magnetic guide and the base, so that a distal end of the at least one spring-loaded magnetic guide is inserted through a first hole in the first flange, (iii) connecting the barrel to the first flange, (iv) connecting the second flange to the barrel so that the barrel is located between the first and second flanges, (v) inserting at least one threaded fastener through a second hole in the second flange such that a distal end of the at least one threaded fastener is magnetically attached to the distal end of the at least one spring-loaded magnetic guide, and (vi) connecting the at least one threaded fastener to the first flange to form the reel.

In step (ii) the distal end of the at least one spring-loaded magnetic guide protrudes above a surface of the first flange. The at least one threaded fastener comprises a bolt, or alternatively a screw and step (ii) includes a step of inserting a corresponding nut into the first hole. The distal end of the at least one spring-loaded magnetic guide can be a distal end of a slidable magnetic body of said guide. Optionally, an alignment guide is secured to the base, and the alignment guide is also received by the first flange. The alignment guide can be an arbor pin or a lug pin.

The inventive method may further comprise step (vii) of inserting an additional threaded fastener into another second hole in the second flange and connecting the additional threaded fastener to the first flange. Alternatively, the method may include step (vii) of inserting an additional threaded fastener into another first hole in the first flange and connecting the additional threaded fastener to the first flange to the second flange.

The above inventive method can also be used with magnetic guides that are not spring-loaded, as described hereinafter.

Another aspect of the present invention is directed to the spring-loaded magnetic guide. The spring-loaded magnetic guide comprises a slidable subassembly adapted to be received through an open end of a tubular housing, which contains a spring. The slidable subassembly comprises a shoulder, sized and dimensioned to have a diameter larger than that of the open end, and a slidable magnetic body adapted to move relative to the shoulder. The slidable magnetic body comprises an enlarged head that is disposed within the tubular body and is adapted to compress the spring when the slidable magnetic body is moved away from the shoulder. The distal end of the slidable magnetic body opposite to the enlarged head is adapted to magnetically attract a distal end of at least one threaded fastener used to assemble the reel and as the at least one threaded fastener advances by rotation the distal end of the at least one threaded fastener pushes the distal end of the slidable magnetic body to compress the spring. Optionally, the spring-loaded magnetic guide further comprises a magnetic disc disposed adjacent to the shoulder of the slidable subassembly.

BRIEF DESCRIPTION OF THE DRAWINGS

In the accompanying drawings, which form a part of the specification and are to be read in conjunction therewith and in which like reference numerals are used to indicate like parts in the various views:

FIG. 3(*b*) is an enlarged, exploded view of the spring-loaded magnetic guide; FIG. 3(*c*) is an enlarged side view of an alternative embodiment of the spring-loaded magnetic guide.

DETAILED DESCRIPTION OF THE PREFERRED EMBODIMENTS

Figure 1:
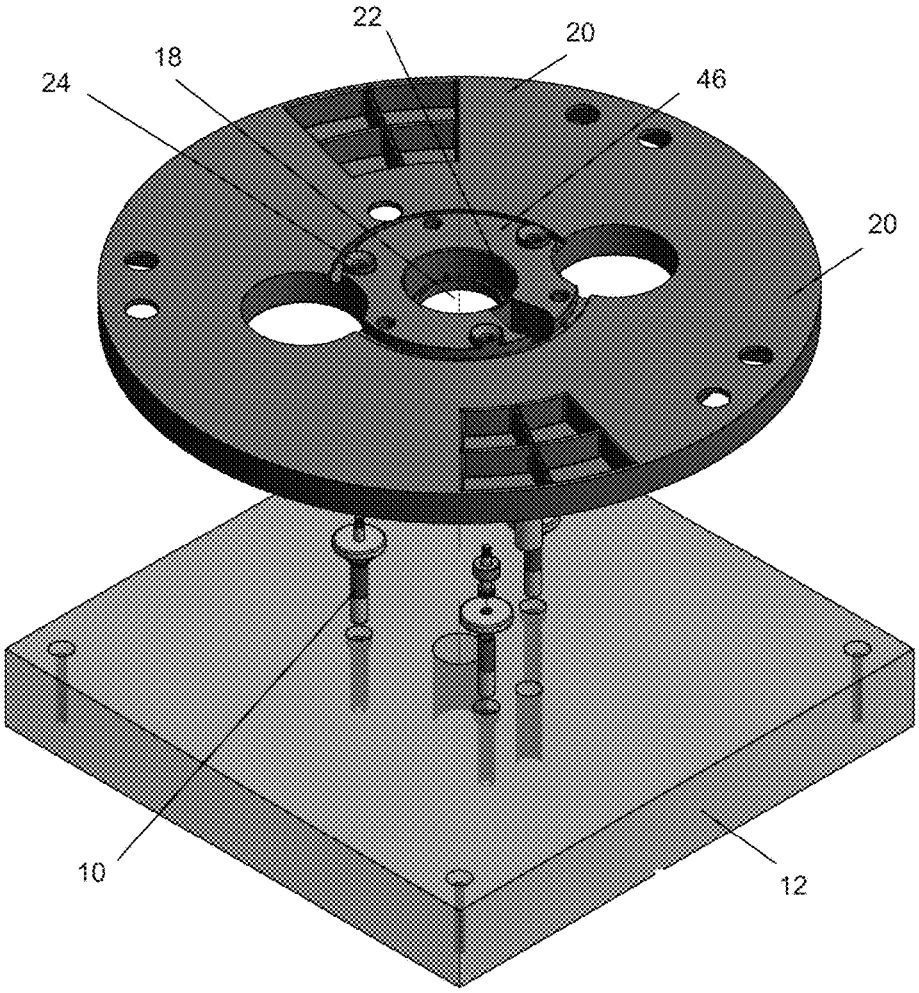
FIG. 1 is a perspective, exploded view of an assembling base, a plurality of spring-loaded magnetic guides, and a first flange, wherein one of the spring-loaded magnetic guide is in an exploded view, and wherein the orientation guides are not fully shown due the angle of the view.
Figure 2:
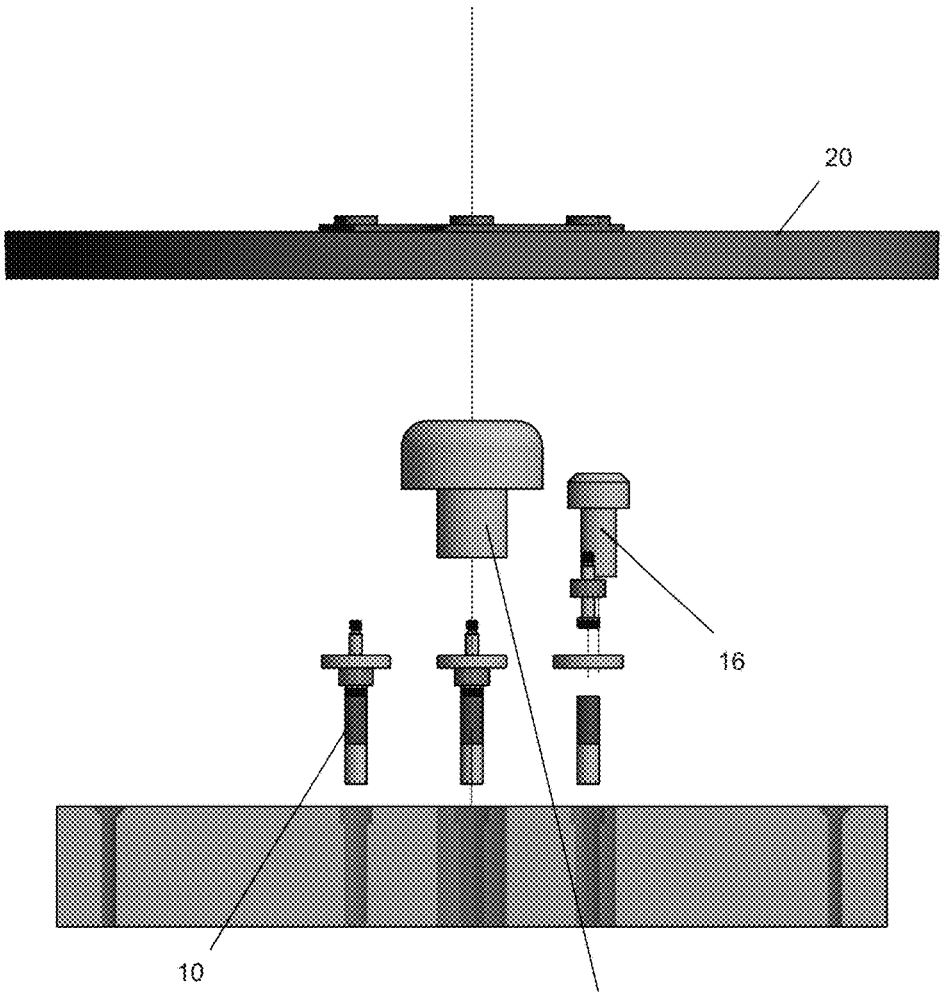
FIG. 2 is a cross-sectional, exploded side view of FIG. 1, showing the orientation guides and the spring-loaded magnetic guides.
Figures 3A, 3B, 3C:
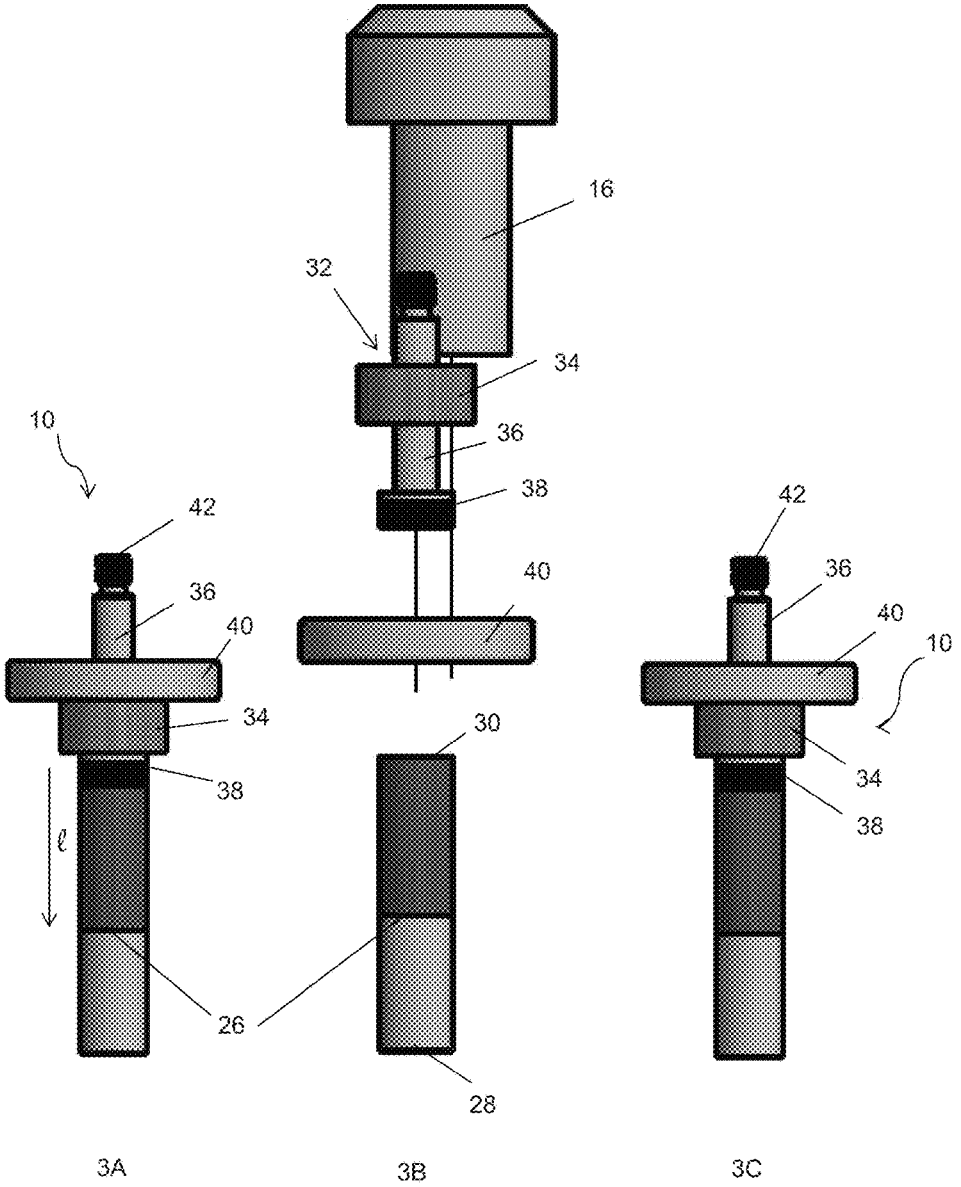
FIG. 3(*a*) is an enlarged side view of one spring-loaded magnetic guide.

The present invention includes, but is not limited to, a method of assembling reels using magnetic guides, and the spring-loaded magnetic guides. As best shown in FIGS. 1-3, one or more spring-loaded magnetic guides 10 are inserted into and held by an assembling base 12. Base 12 defines a number of holes sized and dimensioned to accept spring-loaded magnetic guides 10, as well as, an arbor pin 14 and a lug pin 16. Arbor pin 14 is sized and dimensioned to be received in the arbor or center hole 18 in first flange 20, and lug pin 16 is sized and dimensioned to be received in the off-centered lug hole 22. Arbor pin 14 and lug pin 16 are used for alignment purpose, and when necessary only one pin is preferably used. More preferably, arbor pin 14 is used for alignment of first flange 20 to assembling base 12, as illustrated below.

As best shown in FIGS. 1-2, one or more pin 14 or 16 is inserted into assembly base 10 to stabilize first flange 20. Assembly base 10 is illustrated as a finite rectangular shaped slab. However, assembly base 10 can have any shape and can be a part of assembly line comprising multiple bases 10. Three spring-loaded magnetic guides 10 are shown, but any number of guides 10 can be used. Guides 10 are inserted into base 12, and after first flange 10 is positioned above base 12, guides 10 are inserted through corresponding bolt-receiving holes 24 and preferably protrude therethrough, as shown below.

As best shown in FIGS. 3(*a*)-(*b*), a spring-loaded magnetic guide 10 comprises a hollow tubular housing 26 with a retaining end 28 and an open end 30. Tubular housing 26 stores a spring, preferably a helical spring therewithin. Retaining end 28 retains the spring and the open end 30 is adapted to receive a slidable subassembly 32, comprising a shoulder 34 and a sliding magnetic body 36 capable of sliding relative to shoulder 34. Magnetic body 36 also has an enlarged head 38 sized and dimensioned to compress the spring inside tubular body 26, and shoulder 34 is attached to open end 30 of tubular body 26. The diameter of shoulder 34 is larger than that of open end 30, so that magnetic body 36 can slide into and out of tubular body 26. When magnetic body 36 slides inside tubular body 36, enlarged head 38 compresses the spring. Distance "l" is the distance that the spring would compress during the reel assembling process, and is sufficient for the magnetic body 36 to move downward to clear first flange 20.

In another embodiment, an optional magnetic disk 40 is provided, preferably located above shoulder 34, as shown in FIG. 3(*c*). Magnetic disk 40 provides an additional magnetic field to attract the distal end of connecting bolts or screws toward distal end 42 of magnetic body 38.

Figure 4:
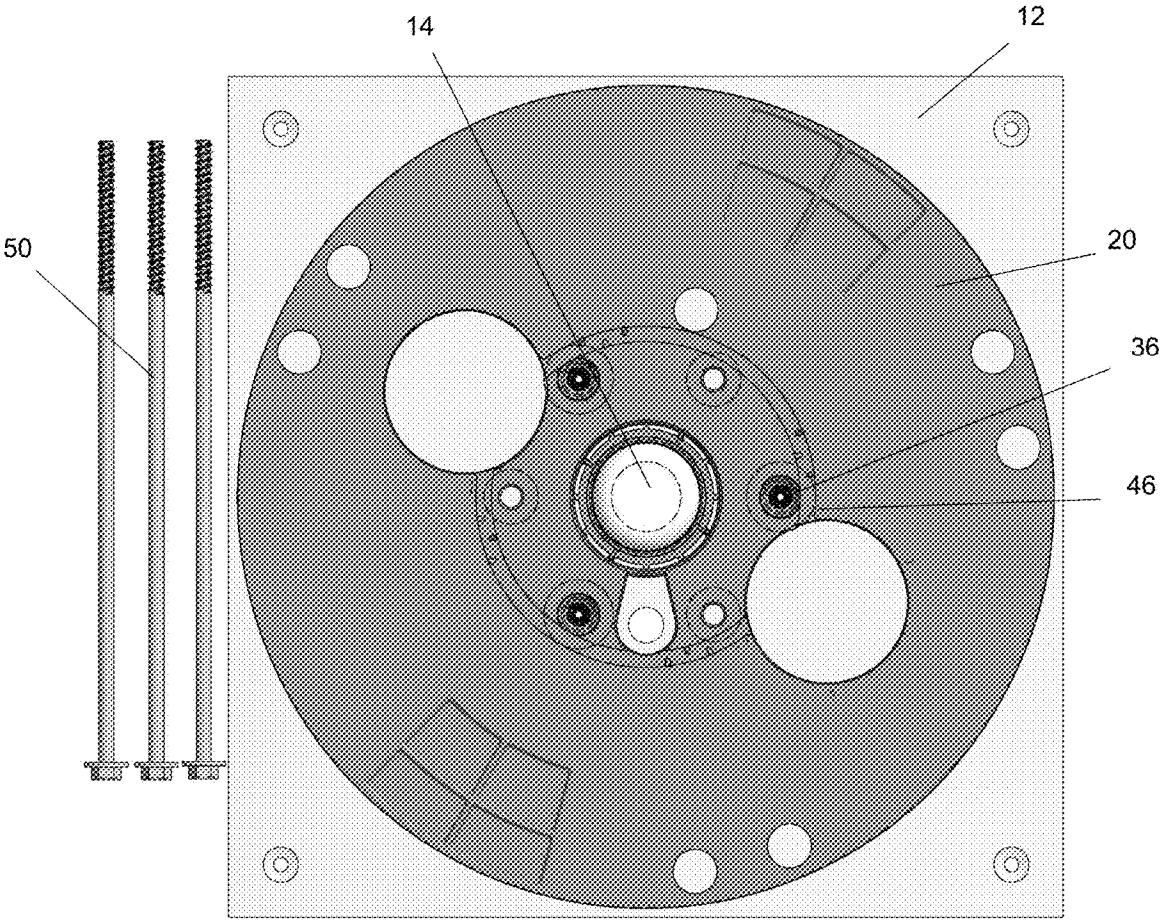
FIGS. 4-8 show the steps in the inventive method of the present invention.

FIG. 4 illustrates the configuration showing first flange 20 being positioned above assembling base 12. Arbor pin 14 is inserted through arbor hole 18 of first flange 20 to help align first flange 12, as well as providing structural support for first flange 20 during the assembling process. The distal ends of sliding magnetic body 36 protrude through the bolt-receiving holes 24.

Figure 5:
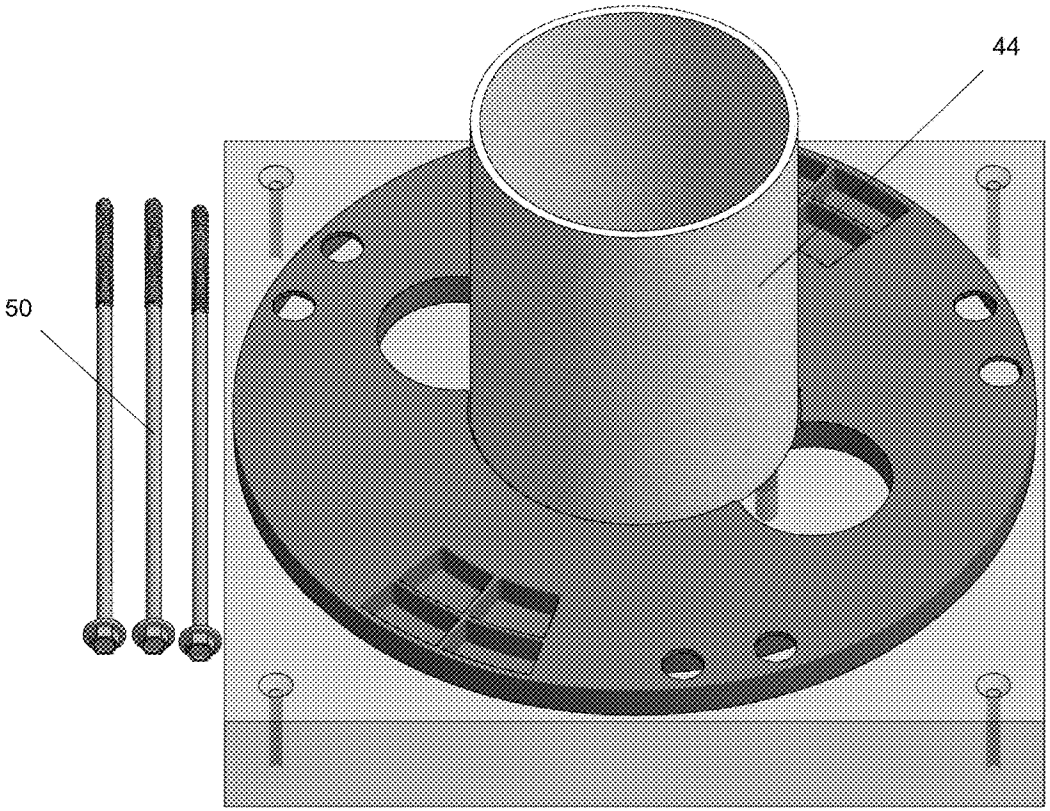
Figure 6:
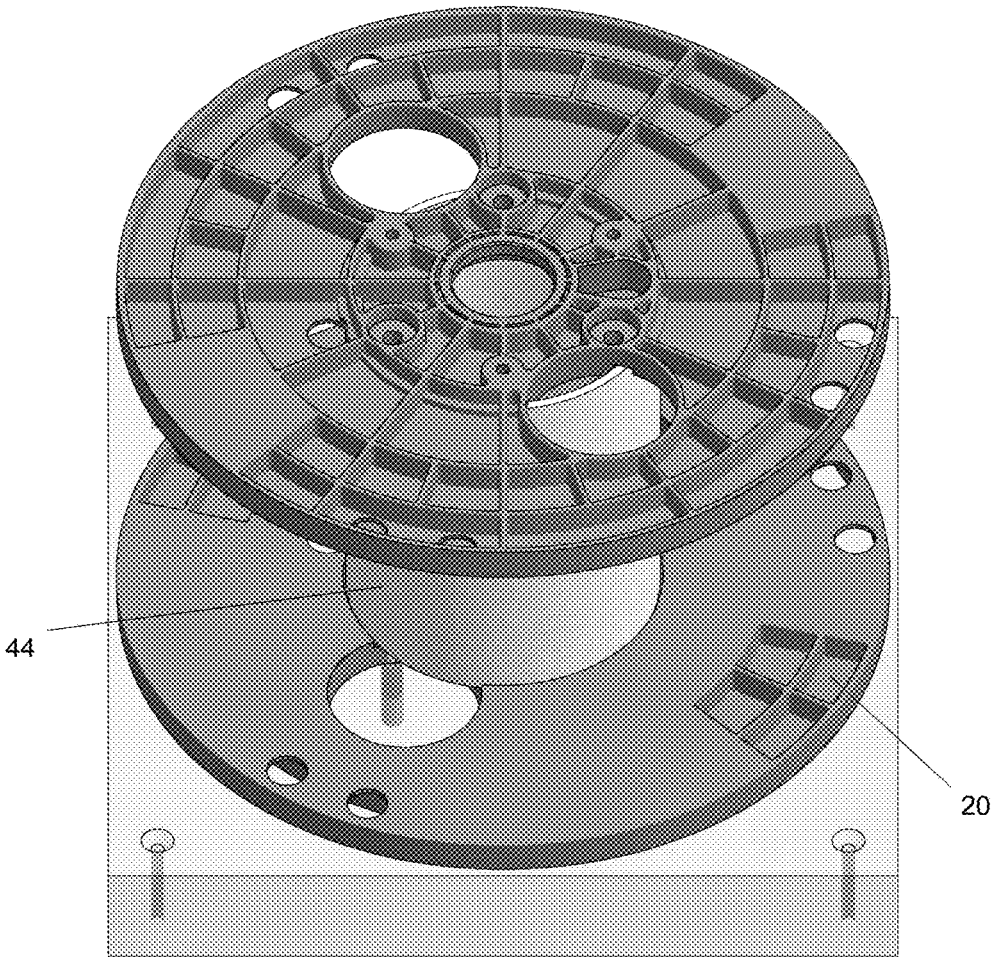
Figure 7:
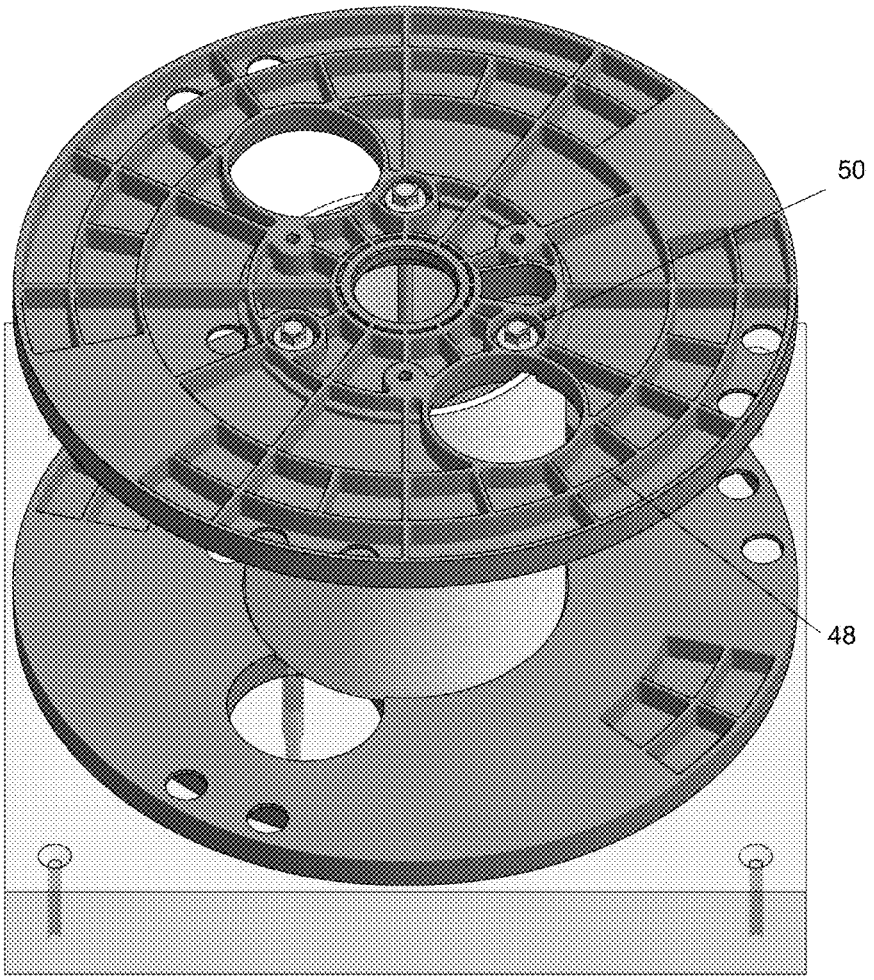

In the next step, a barrel 44 is inserted into route groove 46, which is a circular groove located concentrically outside of arbor hole 18, as illustrated in FIG. 5. In the next step, second flange 48, which is preferably substantially similar to or the same as first flange 20, is positioned on top of barrel 44 in a similar fashion, as shown in FIG. 6. The bolt-receiving holes in second flange 48 only need to be roughly aligned with the bolt-receiving holes in first flange 20. The same number of bolts 50 as the number of guides 10 is inserted into bolt-receiving holes 24 on second flange 48, as illustrated in FIG. 7. Bolts 50, in this embodiment, are shown partially in FIGS. 4 and 5, and in addition to having a bolt head has a threaded distal end and a smooth shaft. In other words, in this embodiment bolts 50 are lagging bolts that after assembling tend to pull the first and second flanges together.

Figure 8:
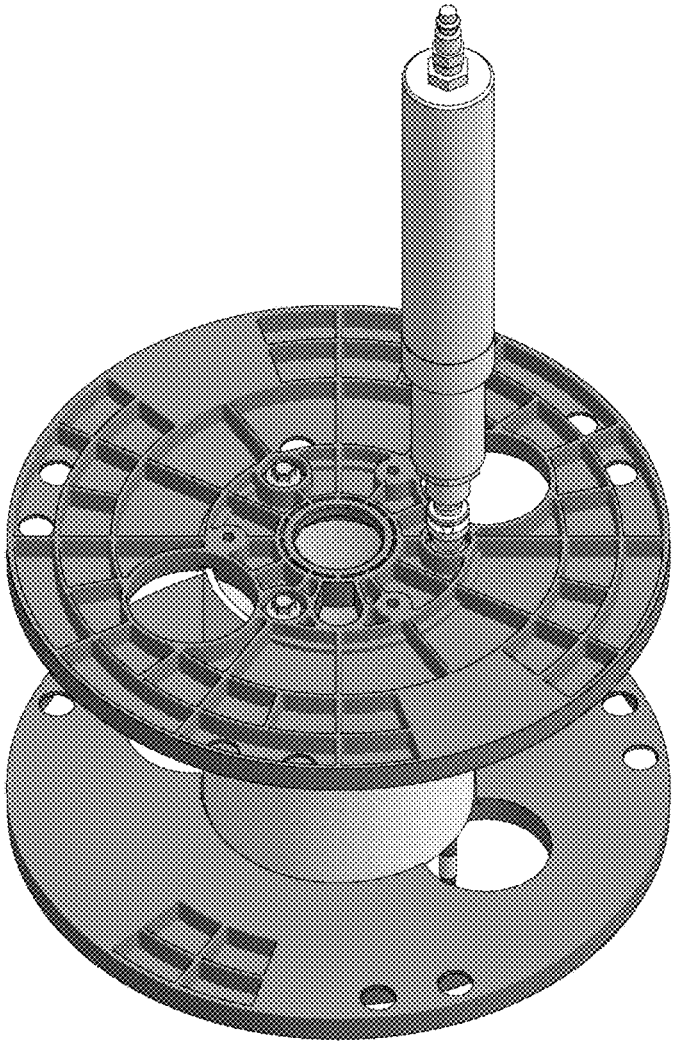

When bolts 50 are inserted, their distal ends are attracted and pulled by the magnetic field/force emanating from slidable magnetic body 36 and/or magnetic disc 40. This magnetic force also aligns bolts 50 to slidable magnetic body 36. As bolts 50 and magnetic bodies 36 make contact, they typically produce a metallic clicking sound informing the operator of the connection. As bolts 50 are advanced by rotation into first flange 20, as illustrated in FIG. 8, the distal ends of bolts 50 push the distal ends of slidable magnetic body 36 against the spring into tubular body 26 of spring-loaded magnetic guide 10. The amount of compression of the spring, labeled as "l" in FIG. 3(*a*), is sufficient for the distal end of bolts 50 to threadedly connect to first flange 20 to complete the assembling of the reel.

As illustrated in FIGS. 4-8, first and second flanges 20 and 48 have six bolt-receiving holes, although the present invention is not limited to any number of holes or bolts, and as illustrated three bolts 50 were used. Any number of bolts can be used so long as the first and second flanges are securely attached. Preferably, each bolt-receiving hole receives a bolt 50. More preferably, some bolts are inserted through second flange 48, as illustrated, and some bolts are inserted through first flange 20, e.g., by inverting the reel, placing second flange 48 on assembling base 10 with the protruding spring-loaded, magnetic guides 10 and repeat the process.

In another embodiment, bolts 50 are replaced by screws 50 of the same length and diameter and nuts that can be threaded onto the distal ends of the screws. The nuts can be inserted into the bolt-receiving holes on the first flange, and slidable magnetic body 36 of guides 10 can protrude through the nuts and are freely movable relative to the nuts. As the screws 50 advance by rotation, the screws displace the slidable magnetic body 36 and are threaded to the nuts to complete the assembly of the reels.

The present invention eases and speeds up the assembly process by facilitating the alignment between the distal ends of the bolts/screws with the bolt-receiving holes/nuts. The present invention also negates the need for the technicians or assemblers to search for the holes or feel for the holes with the distal end of the bolts/screws.

Preferably, flanges 20, 48 are made from plastics, such as thermoplastics and more preferably from molded plastics. Barrel 44 can be made from paper, plastics (thermoplastics or thermosets) or metal (non-ferrous or ferrous). Flanges 20, 48 can also be made from thicker plywood. The magnetic guides could be sized and dimensioned to be used with plywood and/or the magnetic field can be increased to attract the bolts/screws.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

I claim:

1. A method for assembling a reel comprising a first flange, a second flange and a barrel comprising the steps of (i) securing at least one spring-loaded magnetic guide to a base;

(ii) positioning the first flange over the at least one spring-loaded magnetic guide and the base, so that a distal end of the at least one spring-loaded magnetic guide is inserted through a first hole in the first flange, (iii) connecting the barrel to the first flange, (iv) connecting the second flange to the barrel so that the barrel is located between the first and second flanges, (v) inserting at least one threaded fastener through a second hole in the second flange such that a distal end of the at least one threaded fastener is magnetically attached to the distal end of the at least one spring-loaded magnetic guide, and (vi) connecting the at least one threaded fastener to the first flange to form the reel.

2. The method of claim 1, wherein in step (ii) the distal end of the at least one spring-loaded magnetic guide protrudes above a surface of the first flange.

3. The method of claim 1, wherein the at least one threaded fastener comprises a bolt.

4. The method of claim 1, wherein the at least one threaded fastener comprises a screw and step (ii) includes a step of inserting a corresponding nut into the first hole.

5. The method of claim 1, wherein the distal end of the at least one spring-loaded magnetic guide is a distal end of a slidable magnetic body of said guide.

6. The method of claim 1 further comprising the step (vii) of inserting an additional threaded fastener into another second hole in the second flange and connecting the additional threaded fastener to the first flange.

7. The method of claim 1 further comprising the step (vii) of inserting an additional threaded fastener into another first hole in the first flange and connecting the additional threaded fastener to the first flange to the second flange.

8. The method of claim 1 further comprising an alignment guide secured to the base, wherein said alignment guide is also received by the first flange.

9. The method of claim 8, wherein the alignment guide comprises an arbor pin.

10. The method of claim 8, wherein the alignment guide comprises a lug pin.

11. A method for assembling a reel comprising a first flange, a second flange and a barrel comprising the steps of (i) securing at least one magnetic guide to a base;

(ii) positioning the first flange over the at least magnetic guide and the base, so that a distal end of the at least one magnetic guide is aligned with a first hole in the first flange, (iii) connecting the barrel to the first flange, (iv) connecting the second flange to the barrel so that the barrel is located between the first and second flanges, (v) inserting at least one threaded fastener through a second hole in the second flange such that a distal end of the at least one threaded fastener is magnetically attached to the distal end of the at least one magnetic guide, and (vi) connecting the at least one threaded fastener to the first flange to form the reel.

12. The method of claim 11, wherein in step (ii) the distal end of the at least one magnetic guide protrudes above a surface of the first flange.

13. The method of claim 11, wherein the at least one threaded fastener comprises a bolt.

14. The method of claim 11, wherein the at least one threaded fastener comprises a screw and step (ii) includes a step of inserting a corresponding nut into the first hole.

15. The method of claim 11 further comprising the step (vii) of inserting an additional threaded fastener into another second hole in the second flange and connecting the additional threaded fastener to the first flange.

16. The method of claim 11 further comprising the step (vii) of inserting an additional threaded fastener into another first hole in the first flange and connecting the additional threaded fastener to the first flange to the second flange.

* * * * *